United States Patent [19]

Fröhlich et al.

[11] 4,327,906

[45] May 4, 1982

[54] SHEET SEPARATING APPARATUS

[75] Inventors: Eckhard Fröhlich, Ludwigsburg; Günter Mattka, Marbach, both of Fed. Rep. of Germany

[73] Assignee: STAHL GmbH & Co., Ludwigsburg, Fed. Rep. of Germany

[21] Appl. No.: 158,413

[22] Filed: Jun. 11, 1980

Related U.S. Application Data

[63] Continuation of Ser. No. 885,226, May 2, 1978, abandoned.

[51] Int. Cl.[3] ..... B65H 3/08

[52] U.S. Cl. ..... 271/103; 271/90; 271/108

[58] Field of Search ..... 271/103, 93, 108, 14; 414/121, 752, 750, 627; 294/64 R

[56] References Cited

U.S. PATENT DOCUMENTS 1,715,360 6/1929 Harrold ..... 271/103
2,722,416 11/1955 Backhouse ..... 271/108 X
3,000,629 9/1961 Spiess ..... 271/103
4,093,083 6/1978 Klaus ..... 271/103 X

FOREIGN PATENT DOCUMENTS 623151 5/1949 United Kingdom ..... 271/103

*Primary Examiner*—Bruce H. Stoner, Jr.
*Attorney, Agent, or Firm*—Edwin E. Greigg

[57] ABSTRACT

A sheet separating apparatus has a lifting device and at least one suction device. The suction devices receive a sheet from a stack, and with the sheet engaged with the suction devices, are lifted away from the stack by the lifting device. The suction devices are connected to a vacuum source(s) and the lifting device is connected either to the vacuum source, or one of the vacuum sources, or to a different vacuum source or a positive pressure source. In either case the vacuum source(s) acts through the suction devices to produce the engagement of the sheet and suction devices, and this engagement in turn produces a pressure drop in the suction devices which leads to activation of the lifting device to lift the suction devices.

8 Claims, 5 Drawing Figures

SHEET SEPARATING APPARATUS

This is a continuation of application Ser. No. 885,226 filed May 2, 1978, now abandoned.

BACKGROUND OF THE INVENTION

The invention relates to a sheet separating apparatus provided with suction elements which are operated by means of air suction channels for suction attachment of the uppermost sheet of paper, cardboard or the like from a stack of such sheets and a subsequent sequence of a lifting of the suction element holding the sheet and a conveying-on of the sheet, which is thereby detached from the suction element, whereby the pressure drop in the suction channels caused during attachment of a sheet is used to introduce the lifting motion of the suction element holding the sheet.

This type of sheet separating device is known, for example from German Pat. No. 1,085,893. According to the structure disclosed by the German patent, an element of the device that draws a sheet and an element of the device that lifts this first device element with the attached sheet are united in a single piston-like structural element. The suction force of a vacuum source, which effects the suction attachment of the sheet simultaneously causes the lifting suction force for the piston-like structural element, so that the negative pressure that is sufficient for the lifting thereof is automatically set by the attached sheet after the closing of the suction openings. The lower side of a suction nozzle, which comes into contact with the sheet and is formed on the lower end of the piston-like structural element thereby contains at least two separate suction zones, the longitudinal bores of which each lead through the piston-like structural element. These longitudinal bores open on the end of the piston-like element opposite the suction nozzle in such a manner that at the end of the piston stroke the opening of at least one of the longitudinal bores is closed by the cover of the cylinder that guides the piston-like element, and simultaneously a cross bore that communicates with this longitudinal bore is aligned with a ventilation opening that is provided in the guide housing, so that a decrease of the suction force holding the sheet is produced, thus facilitating the removal of the attached sheet.

In devices of this type the piston-like element tends after a period of use to be difficult to move and to jam, because powder, paper dust, fibers and other impurities are aspirated with the sheet that is to be lifted from the stack. These impurities foul-up the piston-like element in the region of the suction nozzle both from the outside, so that the fouled portion travels into the cylinder guide during the lifting movement, and also from the inside, because the longitudinal bore of the piston-like element, in which the negative pressure must be maintained even after the lifting of the suction nozzle, that is, in the uppermost position, must remain in connection with a suction channel in the guide cylinder by means of an opening in the piston wall. The difficulty of operation that is thus produced after a period of time makes it requisite to frequently dismantle the device for cleaning purposes. Decreasing the suctional force which holds the attached sheet, in order to facilitate the removal of the sheet is possible only by an invariable amount; an adaptation to sheets having varying weights and different quality surfaces is not provided.

The basic purpose of the invention is to avoid as far as possible the fouling of the piston-like element of a lifting device in sheet separating devices, of the type mentioned at the outset, by aspirated particles and thereby also to avoid the consequences of such fouling, namely the sticking of the lifting device and wear of the sliding parts, thus making the device as nearly maintenance-free as possible. For sheet separating devices which are to be used in many ways—not just with folding machines—there are, however, a number of additional requirements, whose fulfillment should not be limited by the solution of the problem of avoiding the damaging results of aspirating fouling particles. Such items to be considered are the simplicity of construction, inexpensive production possibilities, rapid operation (which for use of the sheet separating device with a folding machine is very important), and also the effectiveness and adaptability of the devide to the handling of sheets of varying weights and surface qualities.

The solution to the problem according to the invention is that a separating device of the type mentioned at the outset is provided with a lifting device which has a separate energy supply from the suction device, but carries the suction device, and that the pressure drop that appears in the suction channels and suction lines when a sheet is drawn thereagainst is used to control the drive of the lifting device, preferably a pneumatic drive. By means of this separation of the effectiveness of the lifting device from that of the suction device, many advantageous constructional and switching possibilities are opened.

In one exemplary embodiment of the invention a vacuum source is connected as a pneumatic energy source both to (1) the suction line for the suction device that attaches the sheet, and (2) through a second suction line to a slide valve, which in turn acts upon a lifting piston for a carrying body of the suction device. For the control of the slide valve a control line branches off from the suction line for the suction device.

In another exemplary embodiment of the invention a vacuum source is connected to the suction line of the suction device as an energy source and a pressurized air source is connected to the slide valve as an energy source, with the slide valve serving to act upon a lifting piston for a carrying body of the suction device, and a control line for the control of the slide valve branches off from the suction line for the suction device.

A further development of this exemplary embodiment of the invention lies in the fact that at least one branch of the control line is led to at least one further control unit.

In still a further exemplary embodiment of the invention the lift displacement by which the suction device is lifted after the attachment of a sheet is divided into a preliminary stroke that comprises a fraction of the entire stroke and a main stroke, and the preliminary stroke is used to control the feed of the lifting device that causes the main stroke.

The invention will be better understood as well as further objects and advantages thereof become more apparent from the ensuing detailed description of three exemplary embodiments taken in conjunction with the drawings.

DESCRIPTION OF THE PREFERRED EMBODIMENTS

Figures 1, 2, 3:
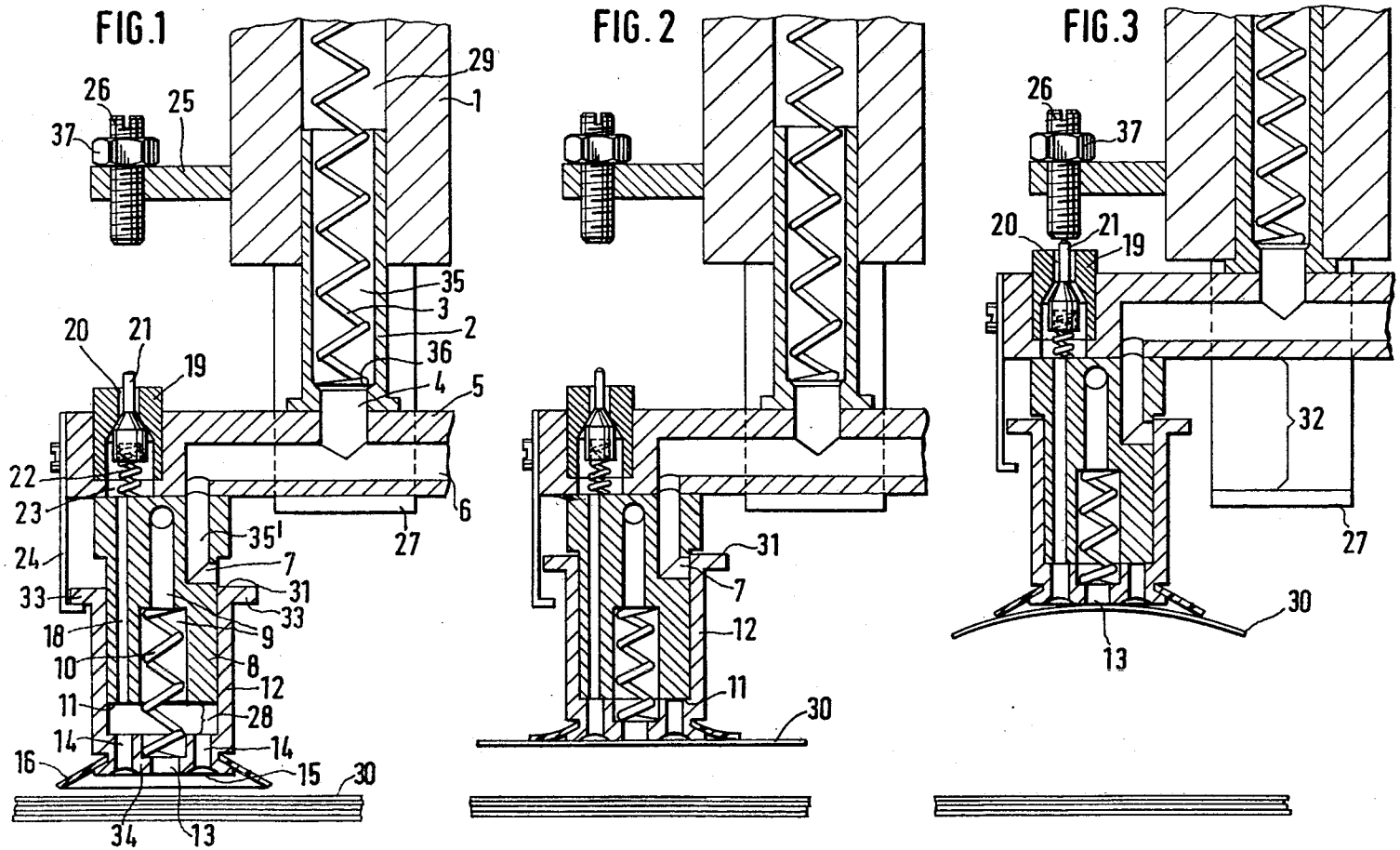
FIG. 1 is an elevational cross-sectional view through a first exemplary embodiment of the invention wherein a sheet separating device is in its lowermost position before a sheet is lifted by suction.
FIG. 2 is another elevational view in cross section after the sheet has begun to be lifted after a preliminary stroke has been carried out, with this preliminary stroke serving for control purposes.
FIG. 3 is another elevational cross-sectional view showing the suction device after the main stroke has been performed.

Turning now to the exemplary embodiment of this invention according to FIGS. 1 through 3, the suction device, which forms a component part of the separating apparatus, has at least one guide body 8 that is held against a supporting body 5. Each guide body 8 contains an appropriately centrally located suction device 9 which is connected to a negative pressure source by means of a conduit (neither of which are shown), and then for example to a vacuum pump or a vacuum line network such as is present in larger operations. The channel 9 extends downward in an elongated portion in which is placed a pressure spring 10 with this spring 10 being arranged to extend beyond the lower portion of the guide body 8 which forms a flat surface 11. A control cylinder 12 is guided, slidingly, along the guide body 8. On its upper end the control cylinder 12 has a flange 33, as shown in FIG. 1, and is supported by the lower inwardly projecting end of a retaining clip 24 which is threadedly attached to the supporting body as indicated at 5. The control cylinder 12 is closed at its lower end by a bottom wall 34 which has a central suction channel 13 and is so arranged to form a seat for the lower end of the spring 10. When the control cylinder 12 is in its lowermost position, as shown in FIG. 1, the upper limiting surface of its bottom wall 34 has a distance from the lower limiting surface 11 of the guide body 8, which distance, as explained below, makes possible a preliminary stroke. Further suction channels 14 are arranged around the central suction channel 13 adjacent to and outwardly of the wall 34 of the control cylinder 12. These channels 14 are connected with an annular channel 15, which is hollowed out in the lower limiting surface thereof, as shown in FIG. 1, by means of which annular channel 15 they remain in contact with each other, even when the suction channels are closed by a sheet lying against their openings, such as shown in FIG. 2. It will be noted upon reference to FIGS. 1 and 2 that a flexible suction plate 16 is retained in a circumferential groove adjacent to the bottom of control cylinder 12. A channel 18 is provided in the guide body 8 on the same axis with one of the suction channels 14, which channel 18 leads through the guide body into a chamber 23 that is arranged in the supporting body 5. A ventilating valve including a body portion 19 is placed in the supporting body 5 and arranged to enclose a spring 22. This spring presses against a valve cone 21 which has an outwardly extending protuberance that passes through a bore 20 in the valve body 19 so that it can be activated from the outside in the manner of a pressure switch.

An air intake opening 7, that is used as a control opening in a manner described hereinbelow, is disposed in the guide body 8 and a channel 35' is connected thereto. When the control cylinder 12 is in its lowermost position as shown in FIG. 1, the opening 7 is opened to atmosphere above the flange 33 that is provided on the upper end of the cylinder 12. The channel 35' extends into a horizontal channel 6 that is disposed in the supporting body 5 and from which a communicating channel 4 leads into the hollow chamber 35 and this in turn extends in an axial direction through a hollow lifting piston 2 that is attached to the supporting body 5. This hollow piston is guided in a cylindrical bore 29 of the housing 1 of the lifting device. A pressure spring 3 has a lower portion abutting against a shoulder 36 that is provided on the lower end of the hollow cylinder 35 with the upper portion of said pressure spring 3 arranged to extend beyond the upper end of the piston 2 and into the cylinder 29. The resisting support of this spring 3 is not shown. An offstanding element 25 is rigidly attached to the housing 1, as shown, with this element 25 arranged to support an adjusting screw 26 provided with a finely threaded shank portion; the screw 26 being secured by a nut 37 to the element 25.

OPERATION

The apparatus according to FIGS. 1 through 3 operates in the following manner.

The channel 9 and the cylinder 29 are connected to a continually operative negative pressure source. In the position of the elements shown in FIG. 1, before the attachment of a sheet 30, the negative pressure prevailing in the cylinder 29 remains ineffective, because air can be aspirated through the control opening 7. The aspiration of air through the channels 13 and 14, which are connected with each other by the annular channel 15 inside the suction plate 16, cause the uppermost sheet 30 of the stack, above which the separating device is located, to be drawn up. It will be readily appreciated that the attached sheet closes the annular channel 15 that communicates with the suction openings 14 and the suction opening 13. Under the influence of the continuously effective vacuum source, the pressure above the top limiting surface of the wall 34 of the control cylinder 12 therefore decreases; the control cylinder is therefore drawn upward against the effect of the spring 10 by the distance 28 (see lower portion of FIG. 1) that represents the preliminary stroke path between the upper limiting surface of its wall and the lower limiting surface 11 of the guide body 8, until the upper limiting surface of the wall 34 lies against the lower limiting surface 11 of the guide body 8. In this position the surface 11 closes the suction channels 14 (see FIG. 1) which are connected by the annular channel 15. However, the negative pressure that prevails in these channels remains in force for a period of time. A control edge 31 that is formed on the upper flange 33 of the control cylinder 12 closes the control opening 7 after completion of the preliminary stroke 28 and the elements then assume the position shown in FIG. 2. By closing the control opening 7, the pressure in the cylinder 29 drops even further under the effect of the vacuum source that is connected thereto so that the hollow piston 2, together with the attached supporting body 5 and all of the elements that are attached to the supporting body especially the guide body 8 with the control cylinder 12 and suction plates 16 are raised against the effect of the spring 3 and namely by the distance 32 (see FIG. 3) which comprises the main stroke which corresponds to the distance of the upper surface of an attaching flange that is arranged on the bottom of the hollow piston 2 from the lower limiting surface of the housing 1. Thus at the end of the main stroke the elements are then positioned as shown in FIG. 3. Shortly before this position is reached, the pin of the valve plate 21 which projects out of the valve body 19 strikes against the lower end of the adjusting screw 26 so that the ventilation valve is opened and thereby the negative pressure in the suction channels 14 and the annular channel 15 that connects them together is increased. The sheet 30 is then held only by the weaker negative pressure that continues to be effective in the suction channel 13 of the channel 9, so that it can easily be pulled from the suction plates 16 by a device that then transports the sheet further. When the sheet is pulled away, the annular channel 15 with the communicating channels 14 and 13 are once again opened so that the air can flow in freely and the pressure above the upper limiting surface of the wall 34 of the control cylinder 12 again rises. Thus it will be clear from the foregoing that the control cylinder, supported by the effect of the spring 10, can then fall from the position shown in FIG. 3 into the original position shown in FIG. 1. The fall is limited by the striking of the lower portion of the flange 33 against the inturned bent edge of the retaining clip 24.

Moreover, similar guide bodies with control cylinders can be located on the supporting body 5 behind the guide body 8. In such a case, all of the control openings 7 are arranged in such a manner that all of the control cylinders 12 must have closed all of these control openings 7 with their control flanged portions 31 before the hollow piston 2 performs the main stroke movement 32. This prevents the possibility of a one-sided lifting of a sheet 30 by, for example, only one suction plate 16.

As described above, when the control cylinder 12 has fallen back into its original position, the control openings 7 are again opened as air intake openings, so that the pressure in the cylinder 29 again rises. It is also to be understood that the hollow piston 2 falls back into its original position under its own weight and the weight of the elements it carries as well as by the effect of spring 3. Thus, body 5 that is connected to the piston 2 again rests on the stop 27.

Because the preliminary stroke 28, which the control cylinders 12 perform during its cooperation with the control openings 7, is only a small fraction of the entire stroke, and also because the control cylinders are guided on the outside on the guide bodies 8 along a significantly long distance, a jamming or sticking of the control cylinder 12 on the guide bodies 8 is precluded. The outward guiding on these guide bodies can also not become fouled by particles found on the sheet and heretofore aspirated together with the sheet, such as powder, dust or fibers of all types, because the aspiration takes place into the central chamber of the guide body 8; in addition the narrower portion of the suction channel 9 has a large enough cross section that these particles are perfectly aspirated. The control openings 7, in contrast, lie so far from the uppermost sheet 30 of the stack that they cannot aspirate particles from the surface of the sheet even during the time that they are open for air intake and in addition they are also protected by the outwardly projecting flange 33. The guiding of the hollow piston 2 in the cylinder 29 of the housing 1 therefore remains continuously clean, so that here, too, there is no malfunctioning of the stroke operation possible because of a direct fouling that produces a sticking or because of excessive wear caused as a result of operation in a fouled condition.

The fine adjustability of the stop 26 for the ventilation valve 19,20,21 makes it possible to adapt the holding force that remains effective during the removal of a sheet to the most varying characteristics of the sheet material and the sheet surface, and especially to the most varying qualities of paper.

Figure 4:
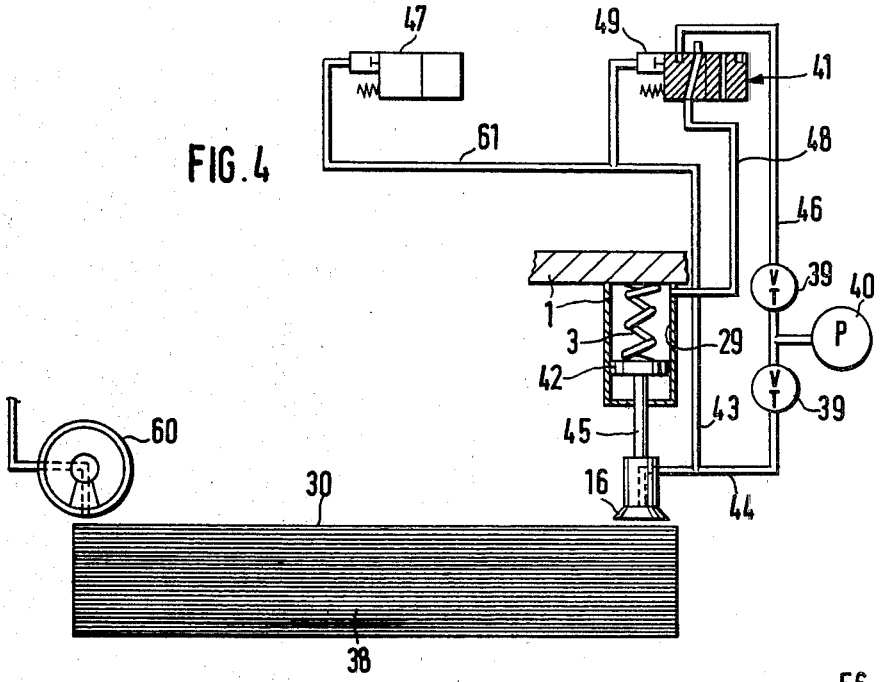
FIG. 4 shows a second embodiment of the invention including details of a hydraulic circuit.
Figure 5:
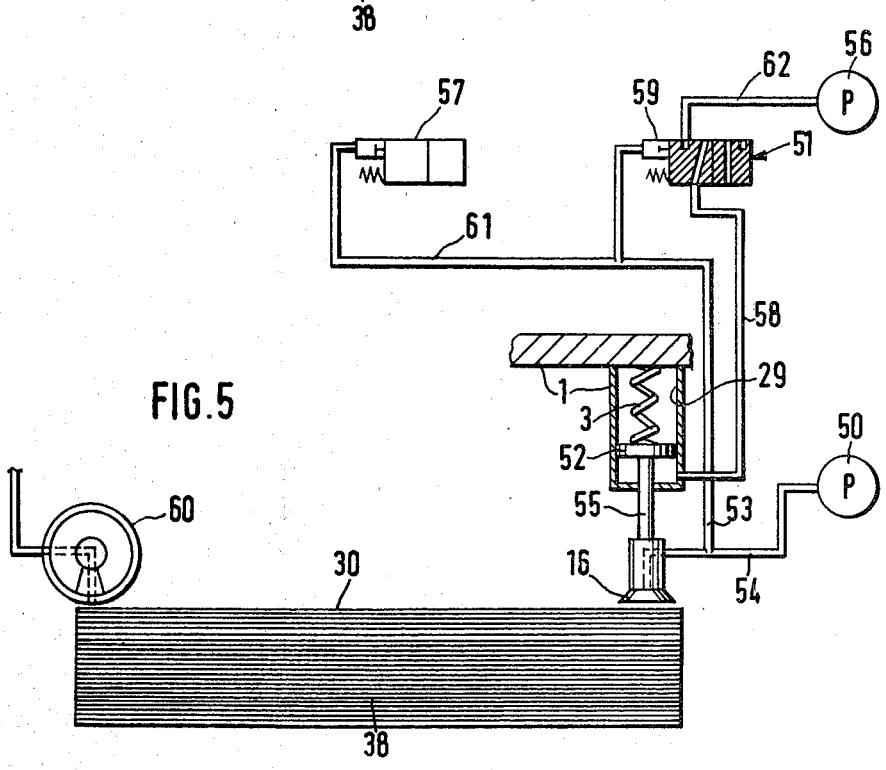
FIG. 5 shows still another embodiment of the invention including details of a hydraulic circuit.

The schematic representations of FIGS. 4 and 5 also make clear for the embodiment according to FIGS. 1 through 3, that the separating device with the suction plates 16 that draw up the uppermost sheet 30 of a stack 38, whereafter it is lifted by means of a lifting device, is arranged at one end of the stack, while a transfer device such as a suction wheel 60 that is shown in FIGS. 4 and 5, is arranged at the other end of the stack. This type of transferring device can be arranged to be continually effective or made only rhythmically effective in dependence on the frequency of the lifting of the other end of the sheet. For example, one could use the pressure drop during the suction attachment of the sheet to the separating device as a control impulse for more than one control process.

The embodiments of this invention according to FIGS. 4 and 5 show that the controlling effect, in contrast to the embodiment according to FIGS. 1 through 3, is not connected to the use of a control cylinder that carries out a preliminary stroke and is located next to the suction device, such as the control cylinder 12 of the described embodiment, so that even with the use of a vacuum source as an energy source for the lifting device that lifts the suction device, no special air intake opening needs to be provided for the activating circuit of the lifting device, not even at a distance from the sheet stack that precludes the fouling of the stroke device.

Referring now particularly to the embodiment of FIG. 4, the suction device with the suction plates 16 is arranged on the supporting body 45 of a lifting device, which comprises a piston 42 that is guided in the cylinder 29 of a housing 1, which piston 42 is connected with the supporting body 45. The piston 42 is subject to the effect of a pressure spring 3. The suction device is further connected to a vacuum pump 40 by means of a suction line 44, from which vacuum pump 40 an additional suction line 46 leads to a slide valve 41. A suction line 48 leads from a support of the slide valve 41 to the cylinder 29. A control line 43 that branches off from the suction line 44 near the suction device that carries the suction plates 16, leads to the control element 49 of the slide valve 41. Adjustable throttle elements 39 are built into the suction lines 44 and 46, which throttles make it possible to conform the suction effects to the length of the lines both for the suction device and for the stroke device.

A branch line 61 of the control line 43 leads to a further control unit 47, which can be formed in a manner similar to the slide valve 41 to control other processes that are dependent on the frequency of operation of the suction device and the lifting device. The attachment of the uppermost sheet 30 of paper to the plates 16 of the suction device takes place here, as in the embodiment according to the FIGS. 1 through 3, without requiring, however, a movable control element on the suction device that would correspond to the control cylinder 12 of the first exemplary embodiment of this invention, and without a preliminary stroke being performed by any element. Only the surge of negative pressure produced during the closing of the suction openings by the aspirated sheet of paper is used by means of the control line 43 to adjust the slide valve 41 in such a manner that the line 48, which was previously connected with a connecting support of the slide valve 41 that led to ambient air, is then connected to the suction line 46. Thus, the pressure in the cylinder 29 drops and the piston 42 of the lifting device is lifted, so that by means of the supporting body 45 the suction device with the sheet attached to the plates 16 is also lifted. By removal of the sheet the air supply into the control line 43 is also opened again, so that the pressure there also again rises and the slide valve 41 is placed back in its original position by means of the control device 49 of the slide valve 41.

Referring at this time to the embodiment of FIG. 5, the suction channels behind the suction plates 16 of the suction device are connected by means of a suction line 54 to a vacuum pump 50. As in the embodiment of FIG. 4, a lifting device that operates with a lifting piston is provided; the lifting piston 52 can lift the suction devices that are arranged on a supporting body 55. The piston 52 is guided in a cylinder 29, which is arranged in a housing 1 of the device, and this housing includes a pressure spring 3 that acts upon the piston 52.

Similarly as in the embodiment according to FIG. 4, where the control line 43 is branched off from the suction line 44, here a control line 53 branches off from the suction line 54, and a control element 59 of a slide valve 51 is influenced thereby. A feed line 58 leads from the slide valve 51 into the chamber of the cylinder 29 beneath the piston 52. In this case it is not an aspirated air flow that is controlled, as in the embodiment according to FIG. 4, but rather a pressurized air flow, which is delivered to the slide valve from a pressurized air source 56 through a pressurized air line 62.

The method of operation is the same as that of the embodiment according to FIG. 4, with the difference that the piston 52 here is not lifted by suction, but rather by the pressurized air that is delivered through the line 58. The adjustment of the slide valve, however, takes place unchanged by means of the pressure decrease surge that is produced during the attachment of the sheet 30. The transmission of the pressure drop into the control lines can perhaps be amplified by a pressure reducer of a known construction.

Also in the embodiment according to FIG. 5, there is provided a branch line 61, which here is branched off from the control line 53, and leads to a further control unit 57.

The additional control units 47 and 57 do not need to be of the same construction, such as the slide valves 41, and 51.

The structure according to FIGS. 1 through 3 can be altered in that by means of the control cylinder 12 a pressurized air impulse can be produced by opening a pressurized air feed to the control lines, instead of using a negative pressure impulse. It is also possible to use the cylinder that controls the negative pressure impulse according to the FIGS. 1 through 3, to activate an electrical contact, which would control the drive of the stroke device that carries the suction device, and has a separate energy source from the negative pressure delivery to the suction device, by means of an electrical signal.

The foregoing relates to preferred exemplary embodiments of the invention, it being understood that other embodiments and variants thereof are possible within the spirit and scope of the invention, the latter being defined by the appended claims.

What is claimed is:

1. A sheet separating apparatus for separating the uppermost sheet of paper, cardboard, or the like, from a stack of such sheets, comprising:

at least one suction device;

a lifting device, which produces a drive for each suction device;

each suction device being mounted to the lifting device for reciprocal movement by the lifting device;

each suction device and said lifting device having vacuum chamber means;

each said suction device including a body portion having at least one suction channel, forming part of its vacuum chamber means through which a suction pressure acts to draw the uppermost sheet from the stack into engagement with the body portion and retain the sheet in engagement with the body portion during subsequent transporting of the sheet away from the stack, and control means connected to the vacuum chamber means of the lifting device, said control means being activated by a pressure drop occuring in the vacuum chamber means of the suction device, produced by the engagement of the uppermost sheet to the body portion, causing the suction in the vacuum chamber means of the lifting device to become effective in the lifting device to thereby lift the suction device through a lift displacement away from the stack;

stop means adjustably connected to the lifting device; and a ventilating valve connected to each suction device, each said ventilating valve engaging said stop means, during the lift displacement of the suction device away from the stack, for actuation thereby, and as a result, communicating a reduced vacuum to the sheet in engagement with the body portion of the respective suction device to facilitate removal of the sheet from the body portion.

2. The sheet separating apparatus as defined in claim 1, wherein the lift displacement of each suction device is divided into a preliminary stroke and a main stroke, said preliminary stroke being a fraction of the main stroke and serving to initiate the main stroke.

3. The sheet separating apparatus as defined in claim 2, wherein the body portion of each suction device comprises: a guide body within which said at least one suction channel and a control opening are formed; and a control cylinder mounted to slide relative to said guide body, said control cylinder including an upper control edge, a bottom wall within which a plurality of additional suction channels are formed, with some of said additional suction channels being connected to the guide body suction channel at least during the preliminary stroke, and a suction plate connected to the bottom wall, wherein the control cylinder with its upper control edge and the control opening form part of said control means, said control cylinder being displaceable toward the lifting device during the preliminary stroke thereby effecting the interaction of the upper control edge and the control opening, wherein the control opening forms part of the vacuum chamber means of the lifting device, and the additional suction channels form part of the vacuum chamber means of its suction device, and wherein the lifting device includes: a supporting body to which the guide body is connected; and a stop engageable by the supporting body, said stop defining the furthest displacement of the suction device relative to said stop means.

4. The sheet separating apparatus as defined in claim 3, wherein the lifting device further includes: a housing which defines a suction cylinder; a lifting piston connected to the supporting body and defining a suction channel which communicates with the suction cylinder; and a biasing spring which biases the lifting piston and supporting body toward the stop, wherein the body portion defines a further suction channel which communicates with the control opening, and the supporting body defines a suction channel which communicates with the further suction channel of the body portion and the suction channel of the lifting piston, wherein the lifting piston suction channel, the further suction channel and the supporting body suction channel form part of the vacuum chamber means of the lifting device, and wherein a pressure drop in the suction cylinder occurs when the control opening is closed by the upper control edge producing the main stroke of the suction device against the biasing force of the biasing spring.

5. A sheet separating apparatus for separating the uppermost sheet of paper, cardboard, or similar light material, from a stack of such sheets, comprising:

a vacuum source;

a suction line connected to the vacuum source;

a suction device connected to the vacuum source by the suction line, said suction device including a body portion containing at least one suction channel through which a suction pressure from the vacuum source acts to draw the uppermost sheet from the stack into engagement with the body portion and retain the sheet in engagement with the body portion during subsequent transporting of the sheet away from the stack;

a lifting device for lifting the suction device and an engaged sheet with a substantially vertical limited stroke, including: a supporting body connected to the suction device; a lifting piston connected to the supporting body; a substantially vertically extending cylinder slidably receiving said lifting piston; and biasing means for biasing said lifting piston into a lower position; said suction device being exposed to controlled upward movement by the lifting device;

a pneumatically controlled slide valve;

a supply line connecting the slide valve to a source of a pneumatic actuating medium;

a further supply line connecting the slide valve to the cylinder of the lifting device on only one side of said lifting piston;

and a control line connected between the suction line and a control element of said slide valve, whereby a pressure drop occuring in said at least one suction channel, produced by the engagement of the uppermost sheet with the body portion, causes the slide valve to connect the actuating medium source to the cylinder through the further supply line to thereby lift the suction device away from the stack.

6. The sheet separating apparatus as defined in claim 5, wherein said actuating medium source is formed by said vacuum source.

7. The sheet separating apparatus as defined in claim 5, wherein said actuating medium source is formed by a pressure source.

8. The sheet separating apparatus of claim 5, further comprising:

at least one control unit for controlling a process associated with the separation of sheet from the stack; and a branch line connecting the control line to said control unit to correlate the operation of said control unit with the operation of said slide valve.

* * * * *